US010807850B2

(12) United States Patent
Oto et al.

(10) Patent No.: US 10,807,850 B2
(45) Date of Patent: Oct. 20, 2020

(54) HYDRAULIC UNIT

(71) Applicant: SHIMADZU CORPORATION, Kyoto (JP)

(72) Inventors: Masao Oto, Otsu (JP); Hideki Higashi, Otsu (JP); Hiroyuki Nishida, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 74 days.

(21) Appl. No.: 16/300,064

(22) PCT Filed: Mar. 15, 2017

(86) PCT No.: PCT/JP2017/010459
§ 371 (c)(1),
(2) Date: Nov. 9, 2018

(87) PCT Pub. No.: WO2017/195462
PCT Pub. Date: Nov. 16, 2017

(65) Prior Publication Data

US 2019/0202675 A1 Jul. 4, 2019

(30) Foreign Application Priority Data

May 12, 2016 (JP) ..... 2016-096126

(51) Int. Cl.
*B66F 9/22* (2006.01)
*F15B 1/26* (2006.01)
(Continued)

(52) U.S. Cl.
CPC ..... *B66F 9/22* (2013.01); *F04B 53/20* (2013.01); *F15B 1/26* (2013.01); *F15B 11/003* (2013.01)

(58) Field of Classification Search
None
See application file for complete search history.

(56) References Cited

U.S. PATENT DOCUMENTS 2,121,534 A * 6/1938 Aikman ..... F04B 39/0011 417/103
2,364,709 A * 12/1944 Greer ..... F15B 19/005 73/168

(Continued)

FOREIGN PATENT DOCUMENTS

CN 103307376 9/2013
JP S56148101 11/1981

(Continued)

OTHER PUBLICATIONS

"Office Action of China Counterpart Application", dated Aug. 16, 2019, with English translation thereof, pp. 1-13.

(Continued)

*Primary Examiner* — Tyrone V Hall, Jr.
(74) *Attorney, Agent, or Firm* — JCIPRNET

(57) ABSTRACT

A hydraulic unit is provided with: a manifold which forms a hydraulic circuit; a tank which is joined to the manifold; and a hydraulic pump which suctions hydraulic fluid in the tank and supplies the hydraulic fluid to the manifold, wherein the base end portion of a suction strainer is fitted into the hydraulic pump, and the suction strainer has such a shape that the base end portion of the suction strainer is not separated from the hydraulic pump in a state where the leading end portion of the suction strainer is in contact with the tank and an opening through which the hydraulic fluid is introduced from the tank is provided at the leading end portion.

2 Claims, 3 Drawing Sheets

(51) Int. Cl.
*F04B 53/20* (2006.01)
*F15B 11/00* (2006.01)

(56) References Cited

U.S. PATENT DOCUMENTS

| | | | | | |
|---|---|---|---|---|---|
| 3,553,965 | A * | 1/1971 | Lathrop, II | F15B 15/18 | 60/470 |
| 4,211,080 | A * | 7/1980 | White | F15B 1/26 | 180/210 |
| 4,462,764 | A * | 7/1984 | Van Zandt | F04B 9/111 | 417/401 |
| 4,851,703 | A * | 7/1989 | Means | F04B 17/03 | 290/1 R |
| 2009/0158725 | A1 * | 6/2009 | Keast | F15B 11/0426 | 60/328 |

FOREIGN PATENT DOCUMENTS

| | | |
|---|---|---|
| JP | S6128481 | 8/1986 |
| JP | H078160 | 2/1995 |
| JP | H08159101 | 6/1996 |
| JP | 2016014410 | 1/2016 |

OTHER PUBLICATIONS

"International Search Report (Form PCT/ISA/210)" of PCT/JP2017/010459, dated Apr. 18, 2017, with English translation thereof, pp. 1-4.
"Written Opinion of the International Searching Authority (Form PCT/ISA/237)" of PCT/JP2017/010459, dated Apr. 18, 2017, with English translation thereof, pp. 1-5.
"Office Action of Japan Counterpart Application", with English translation thereof, dated Jul. 2, 2019, p. 1-p. 9.

* cited by examiner

HYDRAULIC UNIT

CROSS-REFERENCE TO RELATED APPLICATION

This application is a 371 application of the International PCT application serial no. PCT/JP2017/010459, filed on Mar. 15, 2017, which claims priority benefits of Japan Patent Application No. 2016-096126 filed on May 12, 2016. The entirety of each of the abovementioned patent applications is hereby incorporated by reference herein and made a part of this specification.

BACKGROUND OF THE DISCLOSURE

Technical Field

The disclosure relates to a hydraulic unit constituting a hydraulic circuit for lifting and lowering a loading platform of a logistics machine.

Related Art

Conventionally, a hydraulic unit is widely used which includes: a manifold which have a check valve, a switching valve and a relief valve built-in; a tank which is joined to the manifold; a hydraulic pump which suctions a hydraulic fluid in the tank and supplies the hydraulic fluid to the manifold; a suction strainer in which a base end portion is connected to the hydraulic pump; and a return pipe in which the base end portion is connected to the manifold. Such a hydraulic unit constitutes a hydraulic circuit which supplies and recirculates the hydraulic fluid between the hydraulic circuit and an actuator which is connected to the manifold (for example, see patent literature 1).

In such a hydraulic circuit, when the switching valve is in a first state, the hydraulic fluid is supplied from the tank to the hydraulic pump via the suction strainer; furthermore, the hydraulic fluid is supplied to the actuator through the manifold. On the other hand, when the switching valve is in a second state, the hydraulic fluid passes through the switching valve from the actuator, and returns to the tank through the return pipe.

Meanwhile, in the hydraulic unit described above, conventionally, a connection of the hydraulic pump and the suction strainer is conducted by screwing. That is, a male screw is formed on one of the hydraulic fluid inflow port of the hydraulic pump and the base end portion of the suction strainer, a female screw is formed on the other, and the hydraulic pump and the suction strainer are connected by screwing the male screw to the female screw.

However, the conventional constitution of screwing the hydraulic pump and the suction strainer has the problems described below. That is, a processing is necessary to arrange a screw thread on the hydraulic fluid inflow port of the hydraulic pump and the base end portion of the suction strainer, so that man-hours needed for processing increase. Besides, while conducting the screwing, it is necessary to manage the magnitude of a tightening torque so that man-hours needed for assembly also increase. Then, while conducting the screwing, there is also concern that a contamination caused by foreign objects entering the screw groove is generated.

Furthermore, in the hydraulic unit described above, conventionally, the connection of the manifold and the return pipe is also conducted by screwing, and in the connection of the manifold and the return pipe, there are also problems similar to the problems in the connection of the hydraulic pump and the suction strainer described above.

LITERATURE OF RELATED ART

Patent Literature

Patent literature 1: Japanese Laid-open No. 8-159101

SUMMARY

Problems to be Solved

The disclosure focuses on the above points and achieves, without causing increase in man-hours needed for processing or man-hours needed for assembly, a structure in which a suction strainer does not fall out of a hydraulic pump or a return pipe does not fall out of a manifold so that a flow path of a hydraulic fluid can be ensured.

Means to Solve Problems

In order to solve the above problems, the hydraulic unit of the disclosure has a constitution described below.

That is, the hydraulic unit of the disclosure of technical solution 1 includes: a manifold which forms a hydraulic circuit; a tank which is joined to the manifold; a hydraulic pump which suctions the hydraulic fluid in the tank and supplies the hydraulic fluid to the manifold; and a suction strainer in which the base end portion of the suction strainer is fitted into the hydraulic pump; the suction strainer has such a shape that the base end portion of the suction strainer is not separated from the hydraulic pump in a state where the leading end portion of the suction strainer is in contact with the tank, and an opening through which the hydraulic fluid is introduced from the tank is provided at the leading end portion of the suction strainer.

As for such a hydraulic unit, it is unnecessary to perform a processing for arranging a screw thread on the hydraulic pump and the suction strainer, and man-hours needed for processing or man-hours needed for assembly can be reduced. Moreover, the base end portion of the suction strainer is not separated from the hydraulic pump even in a state where the leading end portion of the suction strainer is in contact with the tank and an opening through which the hydraulic fluid is introduced from the tank is provided at the leading end portion of the suction strainer; in this way, a structure can be achieved in which the suction strainer does not fall off out of the hydraulic pump so that the flow path of the hydraulic fluid can be ensured.

The hydraulic unit of the disclosure of technical solution 2 includes: a manifold which forms a hydraulic circuit; a tank which is joined to the manifold; and a return pipe in which the base end portion of the return pipe is fitted into the manifold; and the return pipe has such a shape that the base end portion of the return pipe is not separated from the manifold in a state where the leading end portion of the return pipe is in contact with the tank and an opening through which the hydraulic fluid is circulated is provided at the leading end portion of the return pipe.

As for such a hydraulic unit, it is unnecessary to perform the processing for arranging the screw thread in the hydraulic pump, and man-hours needed for processing or man-hours needed for assembly can be reduced. Moreover, the base end portion of the return pipe is not separated from the manifold even in a state where the leading end portion of the return pipe is in contact with the tank, and an opening through which the hydraulic fluid is introduced from the tank is provided at the leading end portion of the return pipe; in this way, a structure can be achieved in which the return pipe does not fall off out of the manifold so that the flow path of the hydraulic fluid can be ensured.

Effect

According to the disclosure, a structure can be achieved, without causing increase in man-hours needed for processing or man-hours needed for assembly, in which a suction strainer does not fall off out of a hydraulic pump or a return pipe does not fall off out of a manifold so that a flow path of a hydraulic fluid can be ensured.

DESCRIPTION OF THE EMBODIMENTS

One embodiment of the disclosure is described below with reference to FIG. 1 through FIG. 5.

Figure 1:
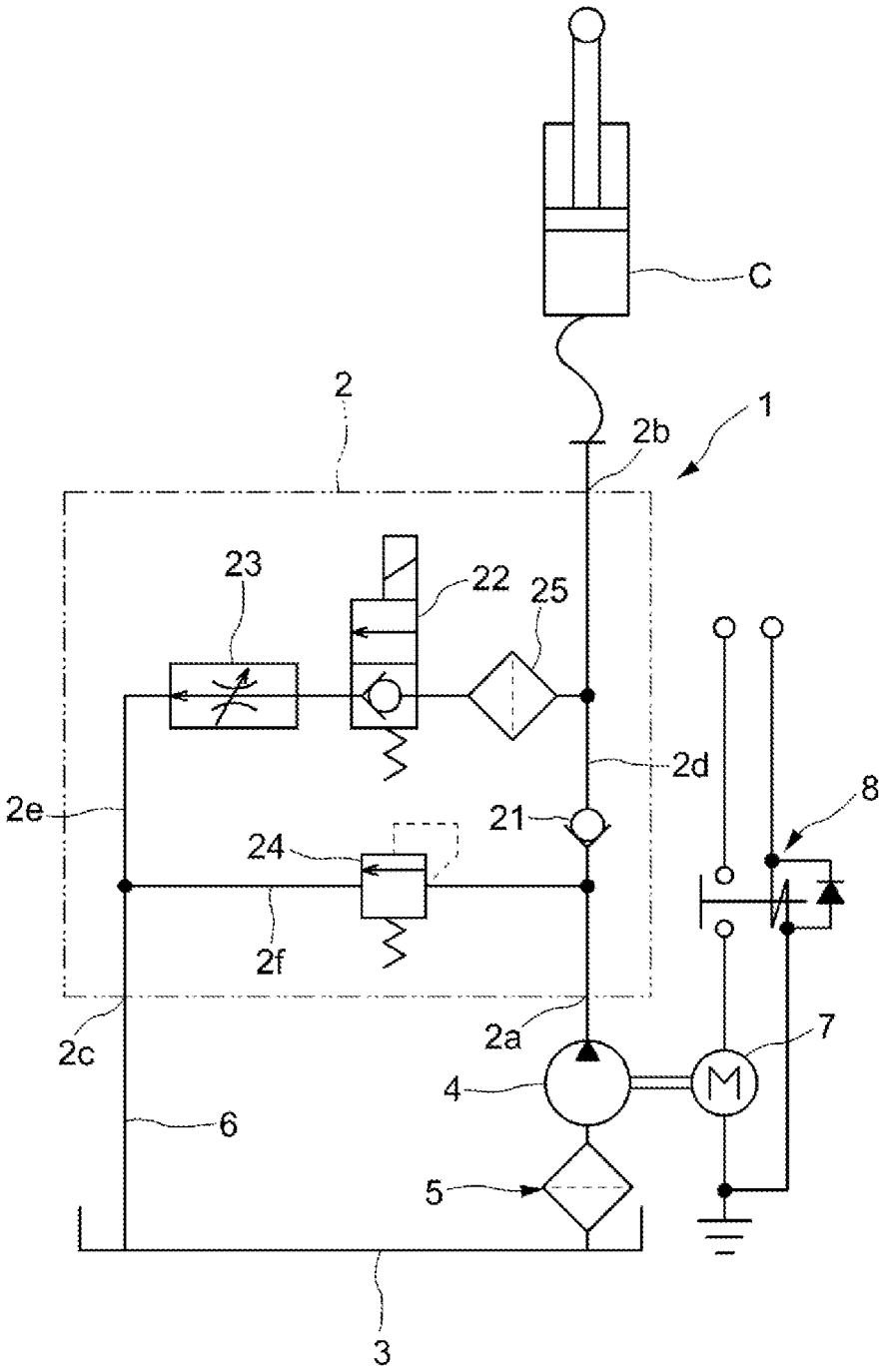
FIG. 1 is a schematic view showing a hydraulic circuit which uses a hydraulic unit of one embodiment of the disclosure.
Figure 2:
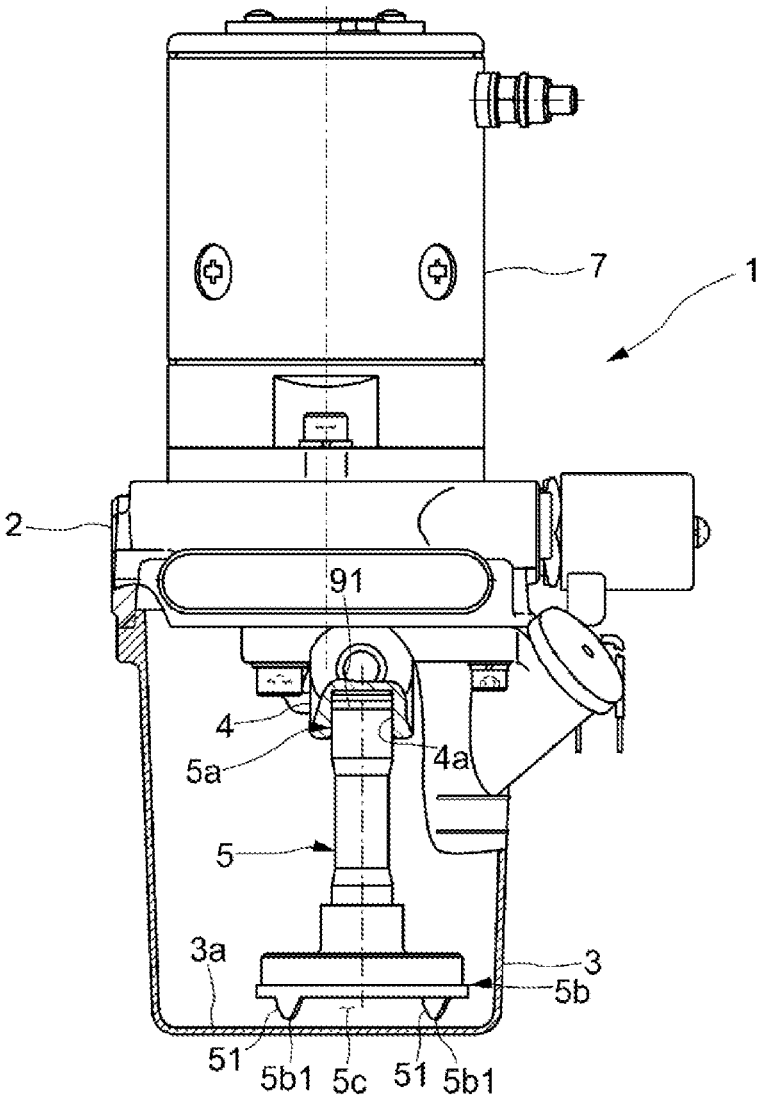
FIG. 2 is a front view showing a hydraulic unit, partly in cross-section, of the same embodiment.
Figure 4:
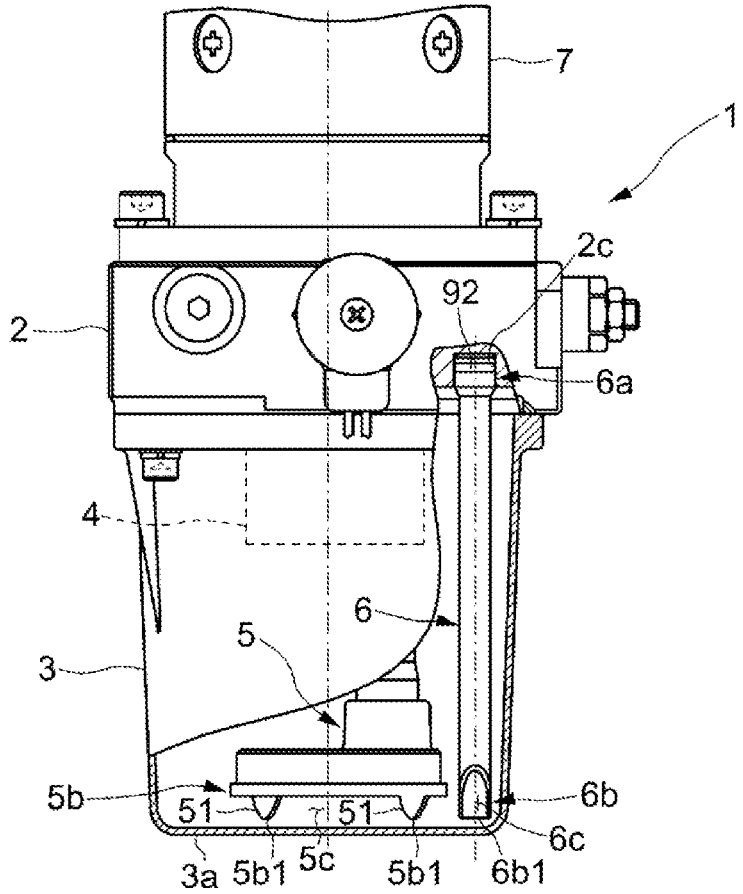
FIG. 4 is a side view showing the hydraulic unit, partly in cross-section, of the same embodiment.

A hydraulic unit 1 of the embodiment supplies a hydraulic fluid to a cylinder C which constitutes an actuator for lifting and lowering a loading platform of a logistics machine, such as a fork lift, which is a driven object, and as shown in FIG. 1, FIG. 2 and FIG. 4, includes: a manifold 2 which forms a hydraulic circuit; a tank 3 which is joined to the manifold 2; a hydraulic pump 4 which suctions the hydraulic fluid in the tank 3 and supplies the hydraulic fluid to the manifold 2; a suction strainer 5 in which the base end portion 5*a* is fitted into the hydraulic pump 4; and a return pipe 6 in which the base end portion 6*a* is fitted into the manifold 2.

The manifold 2 includes, as shown in FIG. 1, a hydraulic fluid inflow port 2*a* which receives a supply of the hydraulic fluid from the hydraulic pump 4; a hydraulic fluid supply port 2*b* which allows the hydraulic fluid in or out between the manifold 2 and the cylinder C; and a hydraulic fluid discharge port 2*c* which introduces the hydraulic fluid discharged from the cylinder C to the tank 3 via the return pipe 6. Besides, the manifold 2 includes the following built-in parts, that is, a hydraulic fluid supply path 2*d*, a check valve 21, a hydraulic fluid discharge path 2*e*, a solenoid valve 22, a flow control valve 23, a relief passage 2*f*, and a relief valve 24. The hydraulic fluid supply path 2*d* is a passage which links the hydraulic fluid inflow port 2*a* and the hydraulic fluid supply port 2*b*. The check valve 21 is arranged in the hydraulic fluid supply path 2*d*, and suppresses a backflow of the hydraulic fluid from the cylinder C side, that is, the hydraulic fluid supply port 2*b* side to the hydraulic pump 4 side, that is, the hydraulic fluid inflow port 2*a* side. The hydraulic fluid discharge path 2*e* diverges from the hydraulic fluid supply port 2*b* side of the check valve 21 in the hydraulic fluid supply path 2*d*, and communicates with the hydraulic fluid discharge port 2*c*. The solenoid valve 22 is arranged in the hydraulic fluid discharge path 2*e*, and selectively takes any one of a first state of obstructing a flow of the hydraulic fluid from the hydraulic fluid supply port 2*b* side to the hydraulic fluid discharge port 2*c* side, and a second state of allowing the flow of the hydraulic fluid from the hydraulic fluid supply port 2*b* side to the hydraulic fluid discharge port 2*c* side. The flow control valve 23 is arranged between the solenoid valve 22 and the hydraulic fluid discharge port 2*c*. The relief passage 2*f* diverges from the hydraulic fluid inflow port 2*a* side of the check valve 21 in the hydraulic fluid supply path 2*d*, and short-circuits a part on the hydraulic fluid discharge port 2*c* side of the flow control valve 23 in the hydraulic fluid supply path 2*d* and the hydraulic fluid discharge path 2*e*. The relief valve 24 is arranged in the relief passage 2*f*, opens when the hydraulic pressure of a part on the hydraulic pump 4 side of the check valve 21 in the hydraulic fluid supply path 2*d* exceeds a predetermined hydraulic pressure, and closes in other cases. Furthermore, a filter 25 is arranged on the upstream side of the solenoid valve 22 in the hydraulic fluid discharge path 2*e*.

As shown in FIG. 2 and FIG. 4, the tank 3 is mounted downward the manifold 2 and stores the hydraulic fluid inside.

As shown in FIG. 2 and FIG. 4, the hydraulic pump 4 is mounted under the manifold 2, suctions the hydraulic fluid inside the tank 3 via the suction strainer 5, and discharges the hydraulic fluid toward the hydraulic fluid inflow port 2*a* of the manifold 2. Besides, the hydraulic pump 4 receives a power supply from a motor 7. The motor 7 is mounted above the manifold 2, and an output shaft of the motor 7 is connected to the hydraulic pump 4. The motor 7 operates when a relay switch 8 is energized.

Figure 3:
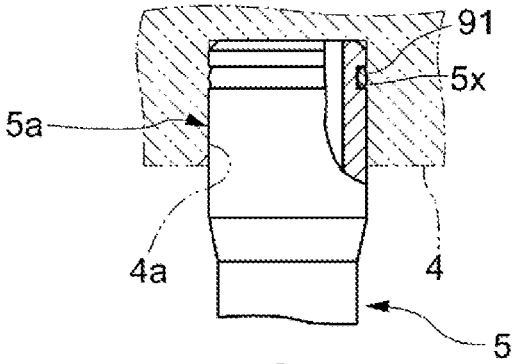
FIG. 3 is a front view showing a base end portion of a suction strainer of the same embodiment.

In regard to the suction strainer 5, as described above, and as shown in FIG. 2, the base end portion 5*a* is fitted into the hydraulic pump 4, and the leading end portion 5*b* is close to or in contact with a bottom wall 3*a* of the tank 3. More specifically, as shown in FIG. 2 and FIG. 3, the base end portion 5*a* of the suction strainer 5 has a larger outer diameter than that of the adjacent part, and includes an O-ring insertion groove 5*x* capable into which an O-ring 91 which is a seal member can be inserted. In regard to the O-ring 91, the inner side part is arranged in the O-ring insertion groove 5*x*, and the outer side elastically adheres to the outer wall of a hydraulic fluid suction port 4*a* of the hydraulic pump 4. On the other hand, the leading end portion 5*b* is provided, at a plurality of locations, with projections 51 which contact with the bottom wall 3*a* of the tank 3 prior to other parts, and the part between the projections 51 is set as an opening 5*c* through which the hydraulic fluid is introduced from the inside of the tank 3.

Figure 5:
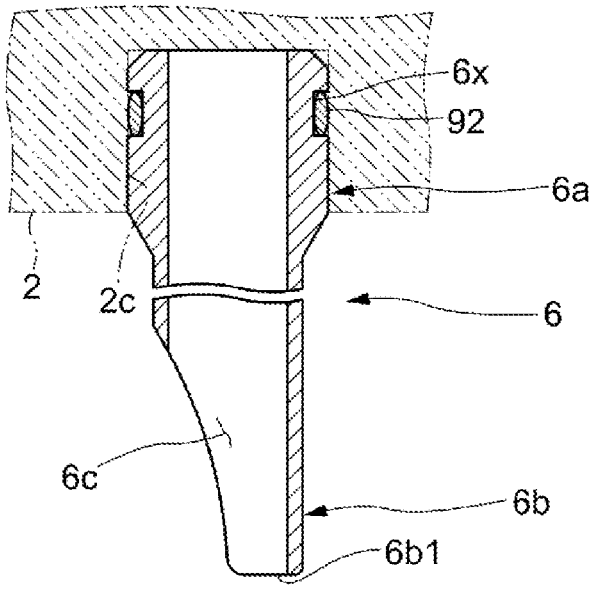
FIG. 5 is a longitudinal sectional view showing an enlarged major portion of a return pipe of the same embodiment.

In regard to the return pipe 6, as described above, and as shown in FIG. 4, the base end portion 6*a* is fitted into the manifold 2, and on the other hand the leading end portion 6*b* is close to or in contact with the bottom wall of the tank 3. More specifically, as shown in FIG. 4 and FIG. 5, the base end portion 6*a* of the return pipe 6 has a larger outer diameter than that of the adjacent part, and includes an O-ring insertion groove 6*x* into which an O-ring 92 which is a seal member can be inserted. In regard to the O-ring 92, an inner side part is arranged in the O-ring insertion groove 6*x*, and the outer side elastically adheres to the hydraulic fluid discharge port 2*c* of the manifold 2. On the other hand, the leading end portion 6*b* is cut in an inclined direction with respect to an extending direction of the return pipe 6, and an opening 6*c* obliquely facing downward is formed. The hydraulic fluid is introduced into the tank 3 through the opening 6*c*. Besides, the leading end 6*b*1 of the return pipe 6 contacts with the bottom wall of the tank 3 prior to other parts.

Here, the suction strainer 5 is arranged so that the leading end 5*b*1 is separated from the bottom wall 3*a* of the tank 3 at first. Then, when the suction strainer 5 moves downward with the passage of time, the projection 51 contacts with the bottom wall 3*a* of the tank 3 prior to other parts, and the hydraulic fluid can be introduced from the tank 3 to the hydraulic pump 4 via the opening 5*c*. On the other hand, the longitudinal dimension of the suction strainer 5 is set so that the base end portion 5*a* does not fall off out of the hydraulic pump 4 even in a state where the projection 51 arranged in the leading end portion 5*b* is in contact with the bottom wall 3*a* of the tank 3.

Besides, the return pipe 6 is arranged so that the leading end 6*b*1 is separated from the bottom wall 3*a* of the tank 3 at first. Then, when the return pipe 6 moves downward with the passage of time, the leading end 6*b*1 of the return pipe 6 contacts with the bottom wall 3*a* of the tank 3, the opening 6*c* of the leading end portion 6*b* of the return pipe 6 keeps open obliquely downward, and the hydraulic fluid can be discharged into the tank 3 via the opening 6*c*. On the other hand, the longitudinal dimension of the return pipe 6 is set so that the base end portion 6*a* does not fall off out of the manifold 2 even in a state where the leading end 6*b*1 is in contact with the bottom wall 3*a* of the tank 3.

That is, according to the mounting structure of the suction strainer 5 of the embodiment, the base end portion 5*a* of the suction strainer 5 is fitted into the hydraulic pump 4, so that it is unnecessary to perform a processing for arranging a screw thread on the suction strainer 5 and the hydraulic pump 4, and thus man-hours needed for processing or man-hours needed for assembly can be reduced. Besides, because it is unnecessary to perform the processing for arranging a screw thread on the suction strainer 5 and the hydraulic pump 4, the occurrence of a defect that chips generated in the processing for arranging a screw thread are mixed into the hydraulic fluid can be prevented. Moreover, the longitudinal dimension of the suction strainer 5 is set so that the base end portion 5*a* does not fall off out of the hydraulic pump 4 even in a state where the projection 51 arranged in the leading end portion 5*b* is in contact with the bottom wall 3*a* of the tank 3, so that the suction strainer 5 can be stably mounted to the hydraulic pump 4 by the simple constitution and few man-hours is needed for processing or few man-hours is needed for assembly. Then, the opening 5*c* is arranged in the leading end portion 5*b* of the suction strainer 5, so that the flow path of the hydraulic fluid can be ensured even in a state where the leading end 5*b*1 of the suction strainer 5 is in contact with the bottom wall 3*a* of the tank 3.

Besides, according to the mounting structure of the return pipe 6 of the embodiment, the base end portion 6*a* of the return pipe 6 is fitted into the manifold 2, so that it is unnecessary to perform a processing for arranging a screw thread on the return pipe 6 and the manifold 2, and thus man-hours needed for processing or man-hours needed for assembly can be reduced. Besides, because it is unnecessary to perform the processing for arranging a screw thread on the return pipe 6 and the manifold 2, so that the occurrence of a defect that chips generated in the processing for arranging a screw thread are mixed into the hydraulic fluid can be prevented. Moreover, the longitudinal dimension of the return pipe 6 is set so that the base end portion 6*a* does not fall off out of the manifold 2 even in a state where the leading end 6*b*1 is in contact with the bottom wall 3*a* of the tank 3, so that the return pipe 6 can be stably mounted to the manifold 2 by the simple constitution and few man-hours is needed for processing or few man-hours is needed for assembly. Then, the opening 6*c* is arranged in the leading end portion 6*b* of the return pipe 6, so that the flow path of the hydraulic fluid can be ensured even in a state where the leading end 6*b*1 of the return pipe 6 is in contact with the bottom wall 3*a* of the tank 3.

Furthermore, the disclosure is not limited to the above embodiment.

For example, the shape of the leading end of the suction strainer may be optionally set, as long as the entire leading end surface of the suction strainer is not in contact with the tank at the same time, that is, as long as an opening for circulating the hydraulic fluid is ensured even in a state where the suction strainer is lowered to the maximum. That is, the number and location of the projection which is arranged in the leading end of the suction strainer may be optionally set; besides, instead of arranging a projection in the leading end of the suction strainer, other constitutions may be adopted, for example, a constitution in which a notch is arranged in the leading end portion of the suction strainer, and the notch is set as an opening through which the hydraulic fluid is introduced from inside the tank.

On the other hand, the shape of the leading end of the return pipe may also be optionally set, as long as the entire leading end surface of the return pipe is not in contact with the tank at the same time, that is, as long as an opening for circulating the hydraulic fluid is ensured even in a state where the return pipe is lowered to the maximum.

Furthermore, the constitution of the disclosure may be adopted to only one of the suction strainer and the return pipe, and the constitution of the disclosure is a constitution which has such a shape that the base end portion is fitted into the hydraulic pump or the manifold, and the base end portion is not separated from the hydraulic pump or the manifold in a state where the leading end portion is in contact with the tank, and which has an opening through which the hydraulic fluid is introduced from inside the tank at the leading end portion.

In addition, various alterations may be made in a scope that does not impair the gist of the disclosure.

DESCRIPTION OF THE SYMBOLS

1 Hydraulic unit
2 Manifold
3 Tank
4 Hydraulic pump
5 Suction strainer
5*a* Base end portion
5*b* Leading end portion
6 Return pipe
6*a* Base end portion
6*b* Leading end portion

What is claimed is:

1. A hydraulic unit comprising:

a manifold which forms a hydraulic circuit;

a tank which is joined to the manifold;

a hydraulic pump which suctions a hydraulic fluid in the tank and supplies the hydraulic fluid to the manifold; and a suction strainer in which a base end portion of the suction strainer is fitted into the hydraulic pump;

wherein the suction strainer is located within the tank and has such a longitudinal dimension that the base end portion of the suction strainer is not separated from the hydraulic pump in a state where the suction strainer is lowered to a maximum and a leading end portion of the suction strainer is in contact with an inner wall of the tank, and an opening through which the hydraulic fluid is introduced from the tank is provided at the leading end portion of the suction strainer in the state where the leading end portion is in contact with the inner wall of the tank.

2. A hydraulic unit comprising:

a manifold which forms a hydraulic circuit;

a tank which is joined to the manifold; and a return pipe in which a base end portion of the return pipe is fitted into the manifold;

wherein the return pipe is located within the tank and has such a longitudinal dimension that the base end portion of the return pipe is not separated from the manifold in a state where the return pipe is lowered to a maximum and a leading end portion of the return pipe is in contact with an inner wall of the tank, and an opening through which a hydraulic fluid is circulated in the state where the leading end portion is in contact with the inner wall of the tank is provided at the leading end portion of the return pipe, wherein the hydraulic fluid is introduced via the opening of the leading end portion of the return pipe into the tank.

* * * * *